US011028513B2

(12) United States Patent
Pintea et al.

(10) Patent No.: US 11,028,513 B2
(45) Date of Patent: Jun. 8, 2021

(54) LOOP GRIPPER HANDLING DEVICE AND HANDLING UNIT AND PROCESS FOR HANDLING LOOP GRIPPER MODULES

(71) Applicant: Groz-Beckert KG, Albstadt (DE)

(72) Inventors: Marius Pintea, Raesfeld (DE); Manuel Wienen, Borken (DE)

(73) Assignee: Groz-Beckert KG, Albstadt (DE)

( * ) Notice: Subject to any disclaimer, the term of this patent is extended or adjusted under 35 U.S.C. 154(b) by 125 days.

(21) Appl. No.: 16/353,620

(22) Filed: Mar. 14, 2019

(65) Prior Publication Data

US 2019/0284741 A1 Sep. 19, 2019

(30) Foreign Application Priority Data

Mar. 15, 2018 (EP) ..... 18162083

(51) Int. Cl.
*D05C 15/22* (2006.01)

(52) U.S. Cl.
CPC ..... *D05C 15/22* (2013.01)

(58) Field of Classification Search
CPC ..... D05C 15/22; D05C 15/24; D05C 15/36; B65D 81/07
See application file for complete search history.

(56) References Cited

U.S. PATENT DOCUMENTS 2,800,096 A * 7/1957 Signoret ..... D05C 15/24 112/80.59
2,944,662 A 7/1960 Colton
3,757,709 A * 9/1973 Cobble ..... D05C 15/24 112/80.6
4,195,580 A 4/1980 Hurst
4,354,441 A 10/1982 Hurst
4,548,140 A * 10/1985 Price ..... D05C 15/145 112/80.3

(Continued)

FOREIGN PATENT DOCUMENTS

DE 2946092 A1 6/1980
DE 10244315 B4 1/2006

(Continued)

OTHER PUBLICATIONS

European Search Report dated Jun. 22, 2018, for European Application No. 18162083.2 (7 pages).

*Primary Examiner* — Tajash D Patel
(74) *Attorney, Agent, or Firm* — Fitch, Even, Tabin & Flannery LLP

(57) ABSTRACT

A handling unit (10) comprises a loop gripper module (11) and a clamping device (12), which has a frictionally engaged connection with the sliders (24-33) of the loop gripper module (11). The sliders (24-33) are lightly clamped in corresponding slots of the clamping device and cannot, even if shaken, slip against one another and in particular they also cannot slide out of the loop gripper module (11). Thus, the sliders are all at the same position, and need not be moved back by hand during mounting. For example, in order to remove clamping device, which is in the form of a plastic clip, the clamping device need only be pressed onto the loop gripper module or be pulled away from the loop gripper module. When this force is applied, the plastic clip is lifted from the sliders (24-33) in a rotating movement.

15 Claims, 3 Drawing Sheets

(56) References Cited

U.S. PATENT DOCUMENTS

| | | | | | |
|---|---|---|---|---|---|
| 4,669,171 | A * | 6/1987 | Card | D05C 15/22 | 29/446 |
| 4,691,646 | A * | 9/1987 | Card | D05C 15/24 | 112/80.6 |
| 5,295,450 | A * | 3/1994 | Neely | D05C 15/22 | 112/80.45 |
| 7,222,576 | B2 * | 5/2007 | Kilgore | D05C 15/22 | 112/80.5 |
| 7,398,739 | B2 * | 7/2008 | Johnston | D05B 59/04 | 112/80.45 |
| 7,562,632 | B2 * | 7/2009 | Hillenbrand | D05C 15/22 | 112/80.55 |
| 2003/0131772 | A1 * | 7/2003 | Green | D05C 15/16 | 112/80.6 |
| 2007/0200286 | A1 | 8/2007 | Hillenbrand | | |
| 2007/0272138 | A1 | 11/2007 | Johnston | | |

FOREIGN PATENT DOCUMENTS

| | | | |
|---|---|---|---|
| EP | 1826307 | A1 | 8/2007 |
| GB | 2115025 | A | 9/1983 |
| JP | S6297961 | A | 5/1987 |
| WO | 03/056091 | A1 | 7/2003 |
| WO | 2006076558 | A1 | 7/2006 |

* cited by examiner

LOOP GRIPPER HANDLING DEVICE AND HANDLING UNIT AND PROCESS FOR HANDLING LOOP GRIPPER MODULES

RELATED APPLICATION(S)

This application claims the benefit of European Patent Application No. 18162083.2, filed Mar. 15, 2018, the contents of which are incorporated herein by reference as if fully rewritten herein.

TECHNICAL FIELD

The invention relates to a loop gripper handling device, a handling unit, and a process for handling loop gripper modules, especially cut pile loop gripper modules.

BACKGROUND

The principle of loop gripper modules is known from the prior art. For example, EP 1 826 307 A1 describes a loop gripper module that has a number of flat gripper fingers that are oriented parallel to one another and that are held in a base body. Every gripper finger is associated with a slider that is movably held on the loop gripper module, in order to control the loop formation process by being made to undergo controlled translational motion relative to the loop gripper module. Every gripper finger is associated with a slider.
As the module is mounted on the tufting machine, the sliders must be connected with a drive element, so that the sliders can be individually moved alone or also moved synchronously on the loop gripper module.

Therefore, as a loop gripper module is mounted on the tufting machine, all sliders must be moved into a uniform coupling position, so that they can be connected with the drive elements with which they are associated.

WO 2006/076558 A1 also discloses a loop gripper module with sliders that are associated with the gripper fingers and that are held so that they are longitudinally movable on the loop gripper module. Here again, the above-mentioned problem arises in the same way.

DE 29 46 092 A1 describes a two-part loop gripper module. It comprises a first base body that holds gripper fingers that are arranged parallel to one another, and a second base body that holds the same number of bails that are oriented parallel to the gripper fingers and that are associated with them. Axial relative motion between the gripper fingers and the bails is not provided.

U.S. Pat. No. 2,944,662 A discloses a packaging for plate-like elements, such as, especially printed circuit boards. The packaging comprises a box with a block arranged in it that has slots in which the flat parts are held by friction. The block can consist of wax or gelatin or also of another material.

DE 102 44 315 B4 further discloses a tool carrier for slide needles and a shipping unit formed from it. The tool carrier is formed by a two-legged, thin-walled profile, whose free legs are slotted. The slots hold the slide needles. A cover closes the rail, to prevent loss of the needles from the carrier rail.

It is one goal of the invention to indicate a concept that can simplify the mounting of tufting modules on a tufting machine.

SUMMARY

This is accomplished with a loop gripper handling device, a handling unit, and a process for handling loop gripper modules as disclosed and described herein.

The inventive loop gripper handling device is suitable especially for handling cut pile loop gripper modules or other tufting modules, which have a number of longitudinally movable sliders. The loop gripper handling device is a clamping device with a number of clamping receptacles arranged in a row. These clamping receptacles are associated with the sliders of the loop gripper module, and can be connected with the loop gripper module. This holds the sliders in their respective axial positions, so that during transport and also during insertion into a tufting machine their axial position relative to the loop gripper module does not change. This makes it especially simple to couple the entire group of all sliders with the drive device as a tufting module is attached to the tufting machine. If the sliders have a coupling recess at their machine-side end, all coupling recesses are in the correct coupling position in which the machine-side coupling part is also located. Thus, the handling of the tufting modules during mounting requires substantially less dexterity than up to now, and can be carried out more quickly and more securely.

Preferably, the clamping device is designed so that the sliders are held in the individual clamping receptacles by friction, so that they cannot be moved in the axial direction. The frictional force acting between the sliders and the corresponding surfaces of the clamping receptacle that lie opposite one another in the clamping receptacles is preferably greater than any accelerating force acting on the sliders that occurs during transport of the loop grippers. This ensures that the sliders do not change their position during transport.

Preferably, the clamping receptacles are slot-like grooves, both of whose facing surfaces are planar or also convex surfaces, which are arranged and shaped to be mirror symmetric to one another about an imaginary midplane of the slot. The surfaces of the clamping receptacle are preferably continuous, forming a large surface area between the respective slider and the surface of the clamping receptacle lying against it. This achieves high static friction, and secures the position of the sliders very well. On the other hand, the surfaces of the clamping receptacles do not predetermine any preferred position of the clamping device with respect to an axis of rotation of the clamping device that is directed transverse to the directions of motion of the sliders. The result is that the clamping device can hold all sliders with substantial clamping force and can nevertheless be put on the sliders, and removed from it by hand. Putting the clamping device on and removing it is substantially facilitated by the possibility of rotating the clamping device about the mentioned axis that is oriented transverse to the sliders.

The clamping device preferably has a number of clamping receptacles whose number coincides with the number of sliders of a loop gripper module. The clamping receptacles are, like the sliders, preferably arranged at uniform distances from one another.

The clamping device is preferably formed by a beam-like body that has a series of slots formed in it that form the clamping receptacles. The body is, for example, a rectangular cuboid. The body preferably consists of a plastic, preferably a plastic that has an inherent pliability that is at least large enough that the clamping forces acting between every slider and its clamping receptacle can be overcome by hand.

The clamping receptacles preferably have, at their open side lying opposite the bottom, a widening forming an insertion bevel which facilitates putting a clamping device onto the sliders of a loop gripper module.

The individual sliders are preferably seated in the clamping receptacles of the clamping device solidly enough that with the clamping device it is possible to pull all sliders out of the gripper module by a linear motion in the longitudinal direction of the sliders. This allows the sliders to be kept ready in the clamping device, for example for regrinding or for cleaning work, and also to be inserted back into the loop gripper module as a group.

According to the invention the loop gripper module and the clamping device form a handling unit, which allows all sliders to be moved together in the axial direction. The clamping device holds all sliders in an identical axial position, so that they cannot move with respect to one another even during transport. This clamping is solid enough that the axial position of the sliders with respect to one another does not change even if the loop gripper module undergoes a shaking movement.

The invention has special advantages for mounting the loop gripper module on a tufting machine. The loop gripper module is set into a swiveling motion on the bar of the tufting machine, during which all coupling ends of the sliders simultaneously engage with the corresponding coupling of the drive part of the tufting machine. After the loop gripper is mounted, the clamping device is removed, so that the sliders can now move freely, controlled by the drive device.

BRIEF DESCRIPTION OF THE DRAWINGS

Further details of advantageous embodiments of the invention are the subject of the description, the drawing, or the subordinate claims. The figures are as follows:

DETAILED DESCRIPTION

Figure 1:
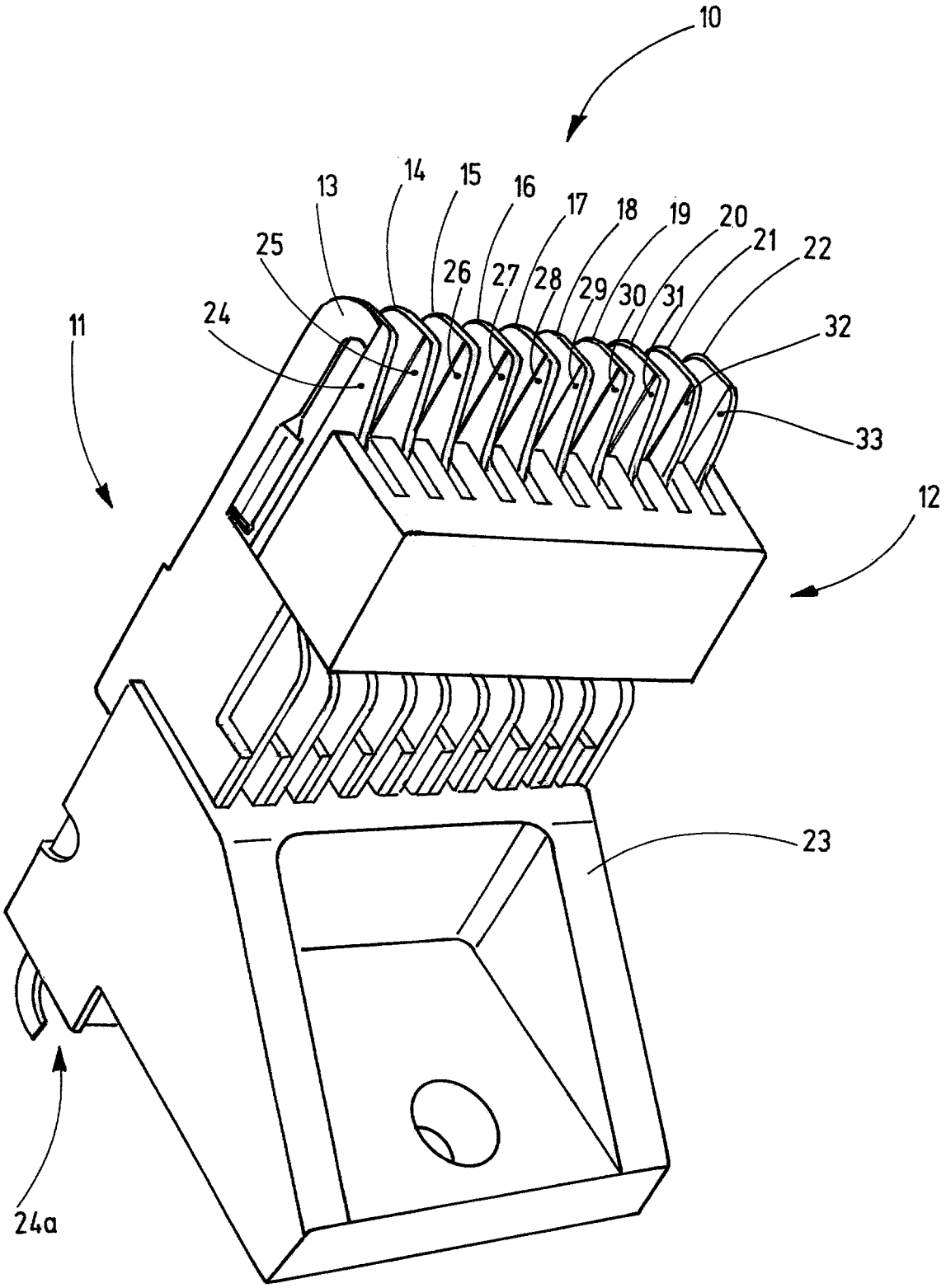
FIG. 1 is a perspective schematic diagram showing a handling unit consisting of a loop gripper module and a clamping device.

FIG. 1 illustrates a handling unit 10, including a loop gripper module 11 and a clamping device 12. The loop gripper module 11 corresponds to a conventional design, such as is disclosed, for example, from WO 2006/076558 A1 or EP 1 826 307 A1. The loop gripper has gripper fingers 13 through 22, which are held in a base body 23 and extend away from the base body 23 parallel to one another at equal lateral distances from one another. The gripper fingers 13 through 22 are secured in the base body 23 so that they are axially fixed.

Every gripper finger 13 through 22 is associated with a slider 24 through 36. The sliders 24 through 33 are supported in the base body 23 so that they are axially movable. To accomplish this, the sliders 24 through 33 are seated in corresponding channels, which are formed in the gripper fingers 13 through 22. The rear coupling sections 24*a* of the sliders 24 through 33 project out of their respective guide channels. The sliders 24 through 33 are straight, flat sheet metal parts, which are held in the predefined axial position by the clamping device 12.

Figure 2:
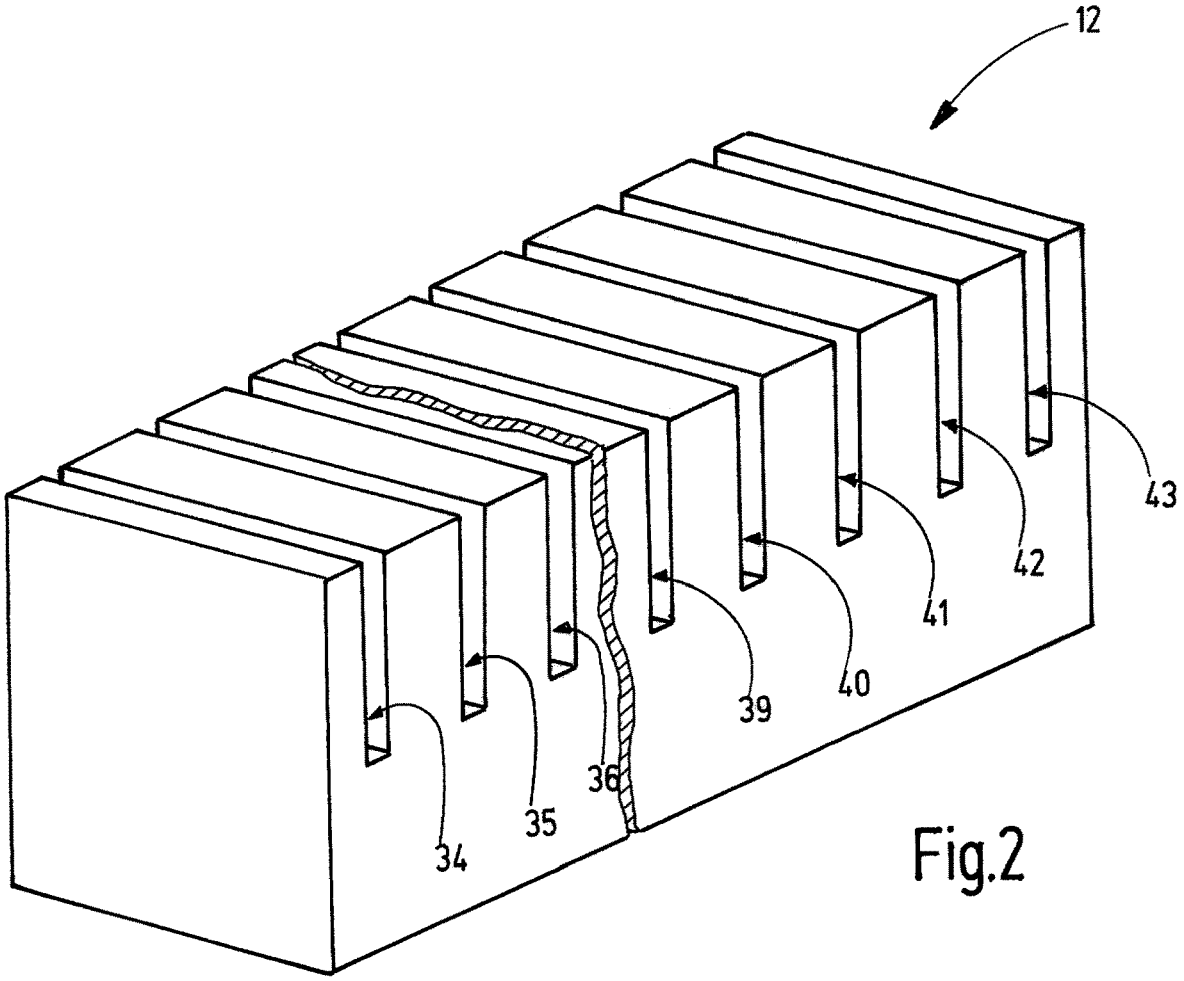
FIG. 2 is a perspective schematic diagram showing the clamping device of the handling unit according to FIG. 1.
Figure 3:
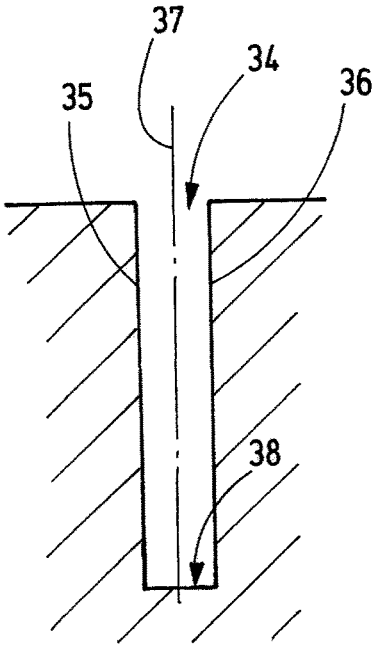
FIG. 3 is a sectional view of a first embodiment of the clamping device according to FIG. 2.

The clamping device 12 is a preferably single-piece, for example cuboid-shaped body made of plastic or another, somewhat pliable material, as is illustrated in FIG. 2. The body 12 has clamping receptacles 37 through 43 formed in it, which are preferably formed by slot-like, straight grooves that are parallel to one another. FIG. 3 illustrates the groove 37 as an example of all grooves 37 through 46, which are arranged at equal distances. The distances between the grooves 37 through 46 correspond to the distances between the sliders 24 through 33. FIG. 3 illustrates a clamping receptacle 34 as a representative of the rest of the clamping receptacles 34 through 43. It is formed by a slot delimited by two preferably planar walls 35, 36. The two walls 35, 36 are arranged symmetrically with respect to a midplane 37. If the wall surfaces 35, 36 bulge, they are also arranged symmetrically with respect to the midplane 37.

Figure 4:
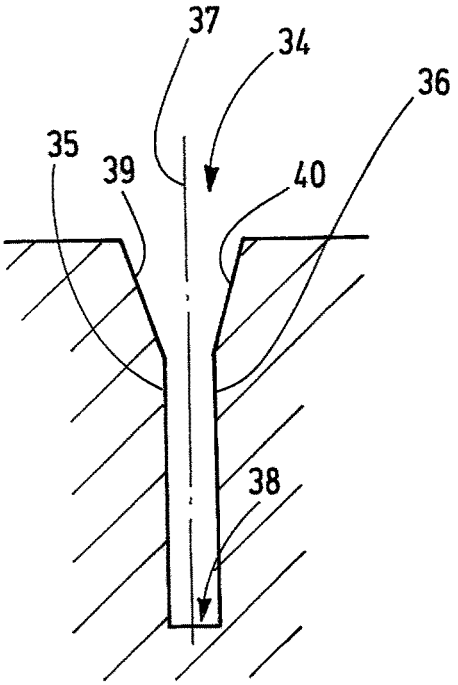
FIG. 4 is a partial sectional view of a modified embodiment of the clamping device according to FIG. 2.

FIG. 4 illustrates a modified clamping receptacle 34, in which the wall surfaces 35, 36 have sloping surfaces 39, 40 at the place farthest away from the slot floor 38, these sloping surfaces 39, 40 forming a wedge-like widening of the clamping receptacle 34 and serving as insertion bevels for the respective slider associated with each of them.

The wall sections of the preferably solid base body of the clamping device 12, which lie between the individual clamping receptacles 34 through 43, can have a certain small pliability, so that every slider 24 through 33 sits clamped, i.e., held in a frictionally engaged manner, in the respective clamping receptacles 34 through 43. The oversize of the slider with respect to the clamping receptacle is preferably dimensioned so that manual force is sufficient to put the clamping device 12 onto the sliders 24 through 33 and to remove the clamping device 12.

Figure 5:
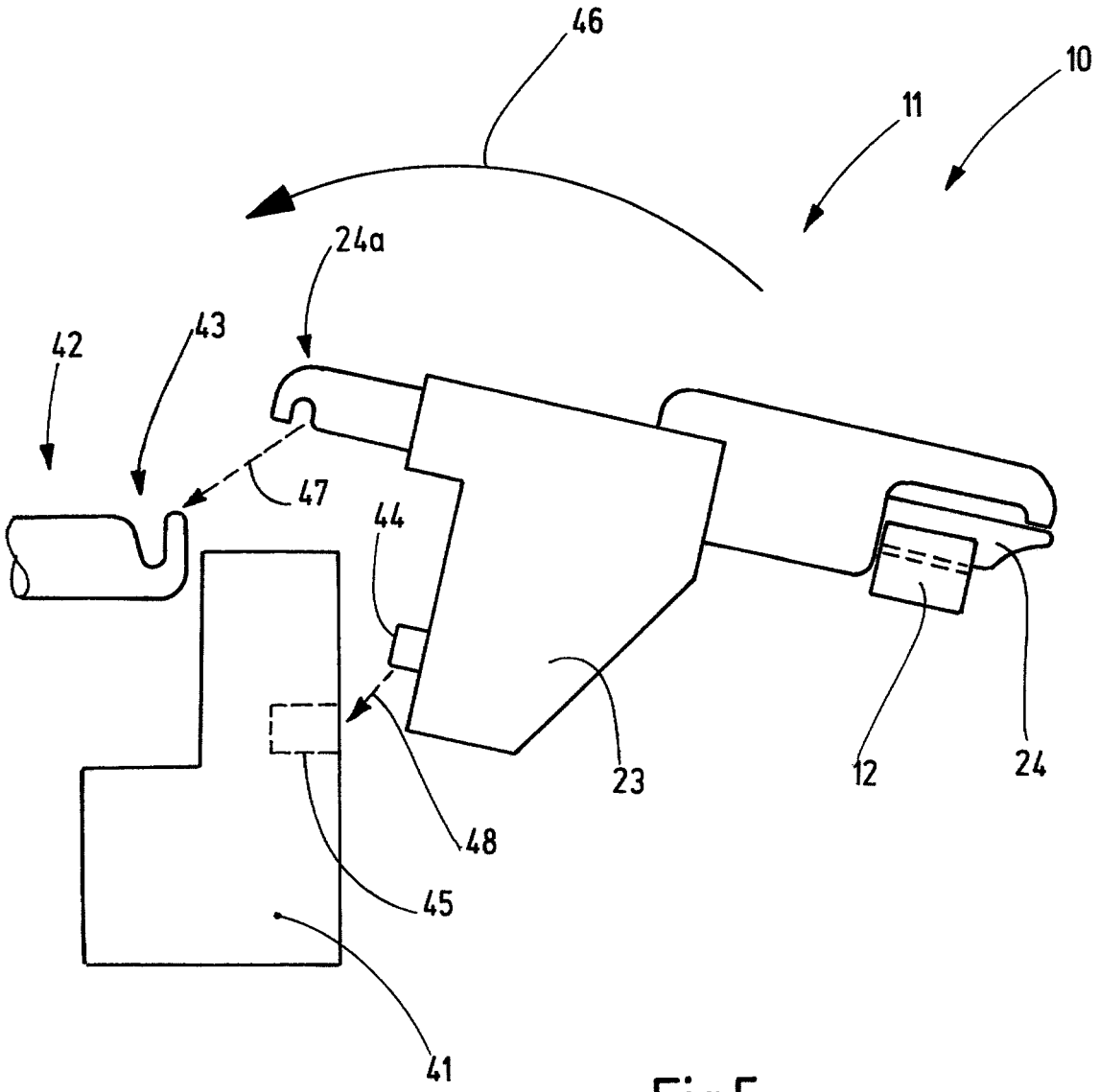
FIG. 5 is a schematic diagram showing the handling unit as it is mounted on a tufting machine.

Assembly with the tufting machine is done as indicated in FIG. 5. For illustration, this figure shows a bar 41 that is fitted with a series of loop gripper modules 11 and that executes an oscillating movement to grip and hold, and possibly cut loops. The bar is associated with one or more drives 42, which carry a coupling structure 43 at their respective module-side end. This coupling structure 43 is set up to engage in a form-fit manner with the coupling end 24*a* of the respective slider 24. The coupling structure 43 and the coupling end 24*a* are complementary to one another, and fit into one another form-fit manner. They can be engaged and disengaged by a coupling movement. The coupling movement typically differs from the longitudinal movement of the sliders 24-33.

To mount the loop gripper module 11, the handling unit 10 is, as illustrated in FIG. 5, put onto the bar 41, which requires that a positioning projection 44 engage into a corresponding recess 45 of the bar 41. The handling unit 10 is set on the bar 41 as indicated in FIG. 5 by arrows 46, 47, 48, with a slight swiveling movement, which involves the positioning projection 44 or any other positioning structure going into the associated recess 45 and the coupling end 24*a* going into the coupling structure 43.

After the loop gripper module 11 is fastened to the bar 41, the clamping device 12 can be removed. The machine is then operational.

For service purposes, the loop gripper modules 11 can be removed from the bar 41. Before the loop gripper modules 11 are detached from the bar 41, first a clamping device 12 is pushed onto all sliders 24 through 33 of every loop gripper module 11. After that, the loop gripper module 11 is detached from the bar 41 and removed. Now, the sliders 24 through 33 cannot be axially moved relative to one another.

However, they can be pulled off as a whole, i.e., all at once from the base body 23 to undergo, for example, cleaning or other processing.

The inventive handling unit 10 comprises a loop gripper module 11 and a clamping device 12, which has a frictionally engaged connection with the sliders 24-33 of the loop gripper module 11, however preferably not with the gripper fingers 13-22. The sliders 24-33 are lightly clamped in corresponding slots of the clamping device and cannot, even if shaken, slip against one another and in particular they also cannot slide out of the loop gripper module 11. Thus, the sliders 24-33 are all at the same axial position, and need not be moved back by hand during mounting. For example, in order to remove clamping device 12, which is in the form of a plastic clip, the clamping device 12 need only be pressed onto the loop gripper module 11 or be pulled away from the loop gripper module 11, both movements possibly combined with rotation about an axis of rotation in the direction transverse to the direction of motion of the sliders 24-33. When this force is applied, the plastic clip can be lifted from the sliders 24-33 in a rotating movement.

REFERENCE NUMBERS

10 Handling unit
11 Loop gripper module
12 Clamping device
13-22 Gripper fingers
23 Base body
24-33 Sliders
34-43 Clamping receptacles
35, 36 Wall surfaces of clamping receptacle 34
37 Midplane of the clamping receptacle
38 Floor of slit
39, 40 Beveled edges serving as insertion bevels
41 Bar
42 Drives
43 Coupling structure
24*a* Coupling end
44 Positioning pin
45 Recess

The invention claimed is:

1. A loop gripper handling device comprising:

a clamping device (12) with a plurality of clamping receptacles (34-43) arranged in a row, wherein individual ones of the plurality of clamping receptacles are configured to hold individual ones of a plurality of moveable sliders (24-33) that are disposed in a loop gripper module (11) such that each of the plurality of moveable sliders held in the plurality of clamping receptacles is held in a fixed axial position relative to an other of the plurality of moveable sliders held in the plurality of clamping receptacles.

2. The loop gripper handling device according to claim 1, wherein every one of the plurality of clamping receptacles (34-43) has only two continuous surfaces (35, 36) that are opposite one another and that define a slot between one another.

3. The loop gripper handling device according to claim 2, wherein the surfaces (35, 36) are planar or convex surfaces, which are mirror symmetric to one another with respect to an imaginary midplane (37) of the slot.

4. The loop gripper handling device according to claim 3, wherein the plurality of clamping receptacles (34-43) in the row are arranged at equal distances to one another.

5. The loop gripper handling device according to claim 1, wherein the plurality of clamping receptacles (34-43) are arranged oriented parallel to one another.

6. The loop gripper handling device according to claim 5, wherein the plurality of clamping receptacles (34-43) are all the same size and shape with an outwardly widening insertion section (38, 39).

7. The loop gripper handling device according to claim 6, wherein the plurality of clamping device (12) has a beam-like body in which the clamping receptacles (34-43) are formed.

8. The loop gripper handling device according to claim 1, wherein the plurality of clamping device has a beam-like body with a rectangular or square cross section that is parallel to the clamping receptacles (34-43).

9. The loop gripper handling device according to claim 1, wherein each of the plurality of clamping receptacles (34-43) is configured to hold one of the plurality of movable sliders (24-33) of the loop gripper module (11) in a given axial position.

10. A handling unit comprising a loop gripper handling device according to claim 1, wherein the plurality of movable sliders (24-33) are longitudinally movable in the loop gripper module (11), and the clamping device (12) is arranged with the plurality of clamping receptacles (34-43) disposed on all of the sliders (24-33) to hold the fixed axial position in a frictionally engaged manner.

11. The handling unit according to claim 10, wherein the clamping device (12) is engaged exclusively with the plurality of sliders (24-33).

12. A process for handling a loop gripper module (11) with multiple grippers (13-22) held in or on a base body (23) and a plurality of moveable sliders (24-33), the process comprising:

providing the loop gripper module (11) with a clamping device (12) having a plurality of clamping receptacles (34-43) arranged in a row, wherein individual ones of the plurality of clamping receptacles are configured to hold individual ones of the plurality of moveable sliders which are disposed in the loop gripper module (11) such that each of the plurality of moveable sliders held in the clamping receptacles is held in a fixed axial position relative to an other of the plurality of sliders held in the plurality of clamping receptacles;

inserting the plurality of moveable sliders (24-33) into the plurality of clamping receptacles (34-43) of the clamping device (12).

13. The process according to claim 12, wherein inserting the plurality of moveable sliders into the plurality of clamping receptacles comprises pushing the clamping device (12) including the plurality of clamping receptacles (34-43) onto the plurality of moveable sliders (24-33) simultaneously.

14. The process according to claim 12, further comprising inserting the plurality of sliders into the plurality of clamping receptacles of the clamping device as the loop gripper module (11) is produced, or after it is produced such that the clamping device remains on the loop gripper module during its storage or transport.

15. The process according to claim 12, further comprising:

inserting the loop gripper module (11) into a tufting machine while the clamping device (12) remains on the loop gripper module (11), and removing the clamping device (12) from the loop gripper module (11) after the loop gripper module (11) is inserted into the tufting machine, and before the tufting machine is put into operation.

* * * * *